United States Patent [19]

Phillips, Jr. et al.

[11] Patent Number: 4,951,319

[45] Date of Patent: Aug. 28, 1990

[54] COLD WEATHER HAT

[75] Inventors: James G. Phillips, Jr., Pleasant Grove, Utah; James M. Clanton, Camp Hill, Ala.; Jerry W. Green, Alexander City, Ala.; Jimmy L. Huett, Alexander City, Ala.

[73] Assignee: Burlington Industries, Inc., Greensboro, N.C.

[21] Appl. No.: 331,370

[22] Filed: Mar. 31, 1989

Related U.S. Application Data

[63] Continuation-in-part of Ser. No. 76,011, Jul. 21, 1987.

[51] Int. Cl.[5] ..... A42B 1/00

[52] U.S. Cl. ..... 2/171; 2/172; 2/175; 2/184; 2/185 C; 2/192; 2/200

[58] Field of Search ..... 2/171, 171.1, 173.5, 2/181, 196, 177, 172, 192, 195, 197, 198, 199, 200, 186, 184

[56] References Cited

U.S. PATENT DOCUMENTS

| | | | |
|---|---|---|---|
| 1,209,121 | 12/1916 | Cohen | 2/185 C |
| 1,505,978 | 8/1924 | Stetson | 2/172 |
| 1,719,706 | 7/1929 | Krans . | |
| 1,816,346 | 7/1931 | Silverstein . | |
| 1,868,281 | 7/1932 | Falkson | 2/190 X |
| 1,879,353 | 9/1932 | Levi . | |
| 2,369,275 | 2/1945 | Biel | 2/195 |
| 2,644,949 | 7/1953 | Greenberg et al. | 2/195 |
| 2,844,820 | 7/1958 | Austin et al. | 2/6 |
| 2,869,134 | 1/1959 | Milstein | 2/172 |
| 2,883,669 | 4/1959 | Rafowitz et al. | 2/172 |
| 2,885,683 | 5/1959 | Lipkin | 2/172 |
| 2,962,723 | 12/1960 | Kronenberger | 2/190 |
| 3,077,607 | 2/1963 | Bregenzer | 2/172 |
| 3,188,654 | 6/1965 | Rafowitz et al. | 2/190 X |
| 3,276,038 | 10/1966 | Fekete | 2/190 X |
| 3,292,182 | 12/1966 | Schuessler | 2/173 |
| 3,307,202 | 3/1967 | Schuessler | 2/173 |
| 4,091,469 | 5/1978 | Davidson | 2/410 |
| 4,222,122 | 9/1980 | Toms | 2/9 |
| 4,370,756 | 2/1983 | Gallin | 2/195 |
| 4,612,672 | 9/1986 | Schrack | 2/68 |
| 4,807,303 | 2/1989 | Mann et al. | 2/69 |

OTHER PUBLICATIONS

"Boy Scouts of America Fieldbook", Boy Scouts of America, Third Ed., 1984.

The Journal of the American Medical Association, vol. 168, No. 7, p. 930, Oct. 19, 1958.

*Primary Examiner*—Werner H. Schroeder
*Assistant Examiner*—Jeanette E. Chapman
*Attorney, Agent, or Firm*—Nixon & Vanderhye

[57] ABSTRACT

A cold weather hat is formed of layered material comprised of an intermediate layer of open-cellular foam, an outer fabric layer, and an inner fabric. The hat has a high moisture vapor transmission rate. The hat has ear flaps which are constructed to conform to the configuration of the sides of an individual's face, eliminating the need for straps, and bill which is movable between upper and lower positions by a snap-type action. Peripheral vision is enhanced while the washer's head is kept warm.

25 Claims, 4 Drawing Sheets

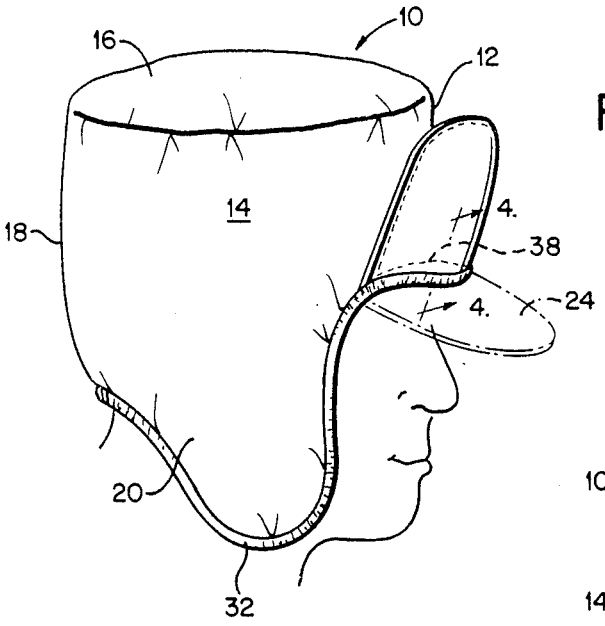
FIG. 1
FIG. 2
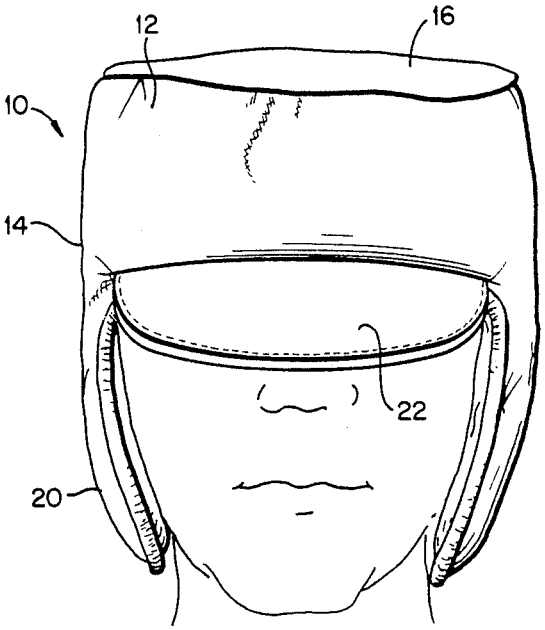
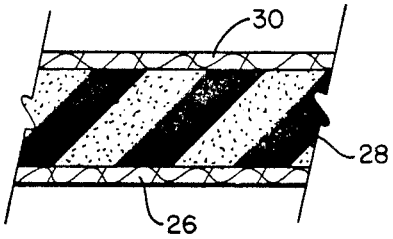
FIG. 3
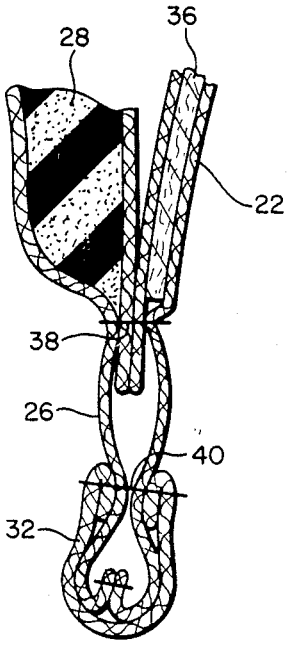
FIG. 4

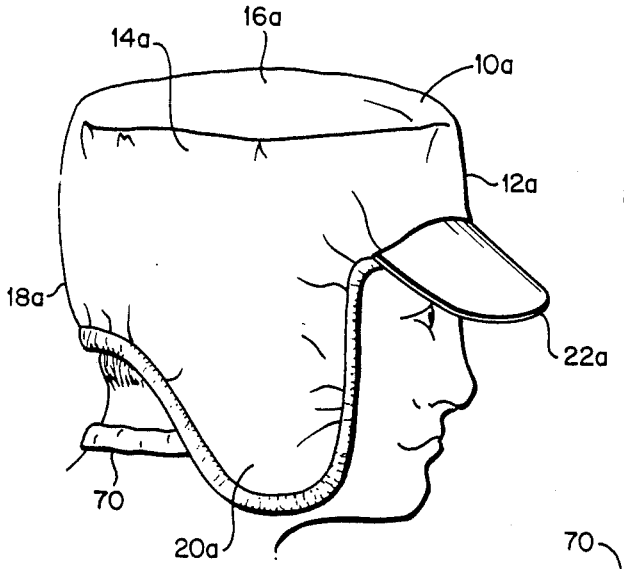
FIG. 13
FIG. 14
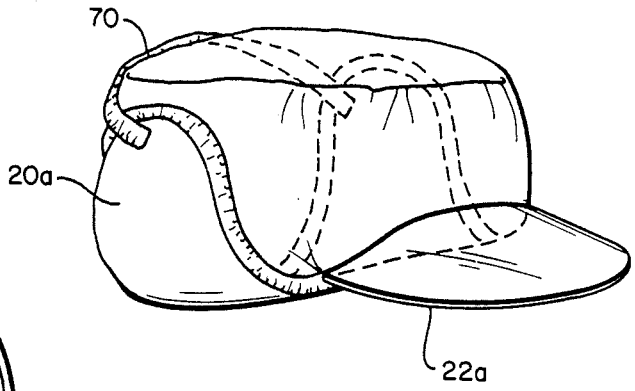
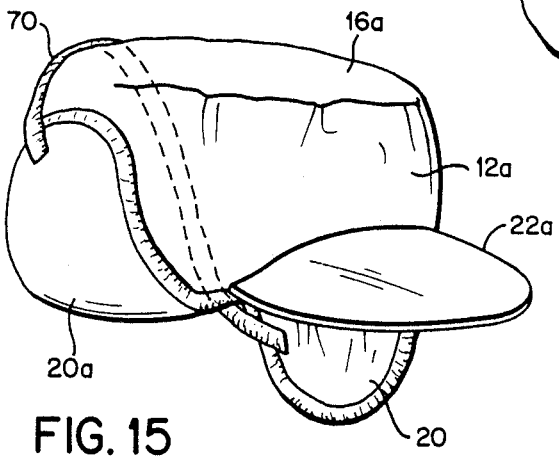
FIG. 15
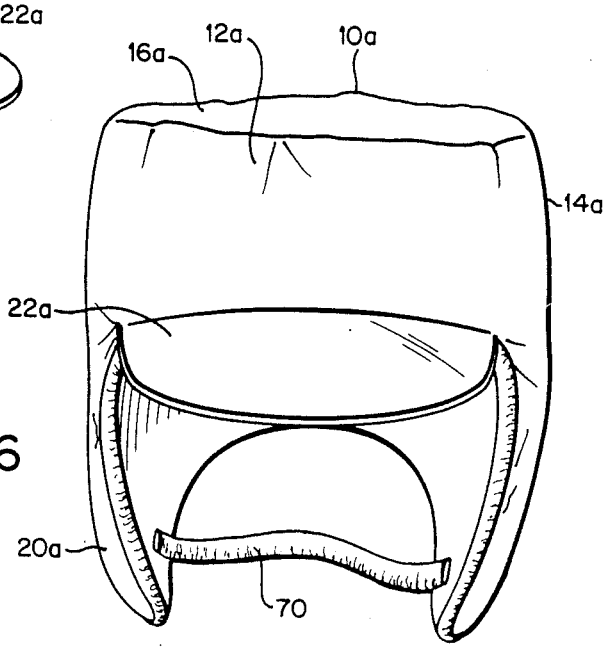
FIG. 16

COLD WEATHER HAT

RELATED APPLICATIONS

This application is a continuation-in-part of application Ser. No. 07/076,011, filed July 21, 1987.

BACKGROUND AND SUMMARY OF THE INVENTION

The present invention relates to clothing for use in cold weather and wind conditions and particularly relates to a novel and improved cold weather hat construction.

Garment systems for use in cold weather have been designed, constructed and used in the past. Many such garment systems employ multiple layers of relatively heavy material in an effort to reduce heat loss. Moisture vapor transmission is often not a consideration in the provision of such garments. Moreover, comfort and fit are often sacrificed to the need for preventing heat loss. One such layered garment system which has solved many of the problems associated with providing effective protection against cold weather comprises a unitary system having an outer shell of nylon, an intermediate layer of polyurethane open-cell foam and an interior woven or knit lining fabric. While this system has proved eminently successful, it does have a disadvantage in affording low wind resistance.

Prior garment systems have often not been extended to peripheral garments, such as mittens or, in the present instance, a cold weather hat. The design of a cold weather hat is often complicated by the particular needs of a hat, in addition to those generally characteristic of cold weather body garment systems. For example, a hat should not only have high resistance to heat loss, but also afford adequate peripheral vision, comfort in its conformance to the contours of the individual's head and face, a bill which can be readily and easily displaced between upper and lower positions and generally not be encumbered by ancillary features, such as buckle-type straps.

According to the present invention, there is provided a cold weather hat having an improved construction which not only accommodates the need to reduce heat loss and improve moisture vapor transmission, but also, by virtue of its construction, affords excellent peripheral vision, comfort in its conformance to the contour of the head and face of an individual wearing the hat, a bill which has an over-center snap-like action to facilitate the movement between up and down positions, and a conformal comfortable fit about the sides of the individual's head for minimizing heat loss and precluding in one form hereof the need for ancillary equipment, such as a chin strap.

Particularly, the present invention includes headwear for cold weather environments comprised of a hat for substantially enclosing the head of an individual and including a hat body having top, side, front and back portions, the side portions having ear flaps for covering the individual's ears. The front portion of the hat extends downwardly from the top portion to overlie at least a portion of the individual's forehead and terminates in a lower edge. The ear flaps are movable between a first position overlying the individual's ears and a second position extending upwardly generally parallel to the side portions of the hat for exposing the individual's ears. The ear flaps, in the first position covering the individual's ears, have forward edges which join with the edge of the front portion to outline top and side portions of the individual's face, the forward edges of the ear flaps lying naturally in close-fitting conformance to and about the individual's face and throughout their lengths. In this manner, the side edges of the ear flaps are spaced back somewhat from the level of the individual's eyes such that excellent peripheral vision is afforded. Additionally, the ear flaps, while readily and easily movable between the first and second positions, are constructed to conform naturally and without additional material to the downwardly and inwardly curved side portions or contours of an individual's head. Thus, the ear flaps, in their first or ear-covering position, fit snugly and comfortably about the individual's face, without the aid of ancillary devices to obtain and maintain that conformance.

The materials from which the hat hereof is constructed include an outer shell formed of a low air permeable material which additionally affords a substantial moisture vapor transmission rate. Alternatively, the outer shell may be formed of a nylon material, with the previously mentioned material forming the inner shell. An intermediate layer of 0.5 inches or more of urethane foam is provided for purposes of warmth. The inner layer is preferably formed of a nylon tricot. An additional advantage of this particular combination of layers of materials resides in the ability of the hat to float in water. Thus, the chance of retrieving the hat if lost "overboard" is substantially enhanced.

In a preferred form hereof, the side portions of the hat and the lower distal end portions of the ear flaps have cooperating hook and loop fasteners such that, when the flaps are moved upwardly to uncover the ears, they may be maintained in such upward second position by engagement of the hook and loop fasteners. Additionally, a bill is provided which projects from the lower edge of the front portion. The bill is movable between a first lowered position projecting forwardly of the hat and a second raised position projecting generally upwardly of the hat, generally conformal to the front hat portion. The connection of the bill to the hat is along a radius greater than the predetermined radius of the forehead portion of the hat and thereby affords an over-center snap-like action whereby the bill can be readily and easily pivoted between these two positions and maintained in the selected position.

In another embodiment of the present invention, the hat is provided with an elastic back strap which serves not only to keep the hat on the wearer's head but also to tension the ear flaps in either their up or down positions. The back strap is permanently attached and sewn to the body of the hat along the rear margin of each of the ear flaps and, thus, does not require snaps, buttons or Velcro for purposes of fastening or unfastening the strap relative to the hat. In a still further form of the present invention, the back of the hat behind the ear flaps and below the back margin may be provided with an elastic panel to provide full coverage of the back of the neck. Additionally, the elastic panel biases the ear flaps in both the up and down position for maintenance in the desired positions.

In a preferred embodiment of the present invention, there is provided headwear for cold weather environments comprising a hat for substantially enclosing the head of an individual and including a hat body having top, side, front and back portions, the side portions including ear flaps for covering the individual's ears, with the front portion extending downwardly from the top portion to overlie at least a portion of an individual's forehead and terminating in a lower edge. The ear flaps are movable between a first position overlying the individual's ears and a second position extending upwardly generally parallel to the side portions of the hat for exposing the individual's ears, the ear flaps in the first position having forward edges joining with the front portion edge to outline top and side portions of an individual's face with the forward edges of the ear flaps lying naturally in close fitting conformance and generally inwardly directed toward one another to and about the individual's face and throughout their lengths. The body of the hat is formed of an interior lining, an intermediate layer of primarily open-cell foam material, and an outer fabric layer, the interior lining and the outer layer being stitched to naturally curve the ear flaps inwardly when in the first position, to naturally conform to the downwardly and inwardly curved side portions of the individual's face.

In another preferred embodiment according to the present invention, there is provided headwear for cold weather environments comprising a hat for substantially enclosing the head of an individual and including a hat body having top, side, front and back portions, the side portions including ear flaps for covering the individual's ears, the front portion extending downwardly from the top portion to overlie at least a portion of an individual's forehead and terminating in a lower edge. A bill projects from the lower edge of the front portion and is movable between a first lowered position projecting generally forwardly of the hat and a second raised position projecting generally upwardly of the hat and generally parallel to the front hat portion, the front portion being formed in a natural shape with a predetermined radius approximating the average radius of an individual's forehead. The bill is secured to the front hat portion along a seam having a radius greater than the radius of the front hat portion, the bill being bowed in opposite directions when in the raised and lowered positions and passing through an over-center position between the raised and lowered positions. The bill is secured to the front hat portion such that the radius of the seam approaches the predetermined radius upon displacement of the bill from the over-center position toward the raised position or the lowered position.

Accordingly, it is a primary object of the present invention to provide a novel and improved cold weather hat having various improved features, including affording excellent peripheral vision, a natural conformance of the hat, particularly the sides of the hat forming flaps which cover the ears, to the contour of the individual's head, a snap-up/down bill with simple one-stroke movement between those two positions and formed of a material affording improved heat loss reduction and higher moisture vapor transmission rates.

These and further objects and advantages of the present invention will become more apparent upon reference to the following specification, appended drawings and claims.

BRIEF DESCRIPTION OF THE DRAWING FIGURES

FIG. 1 is a side perspective view of a cold weather hat constructed in accordance with the present invention;

FIG. 2 is a front perspective view illustrating the hat of FIG. 1;

FIG. 3 is an enlarged fragmentary cross-sectional view of a portion of the hat illustrating its multi-layered construction and taken generally about on line 3—3 in FIG. 1;

FIG. 4 is an enlarged fragmentary cross-sectional view of the hat taken generally about on line 4—4 in FIG. 1;

FIG. 13 is a perspective view of a hat according to a further embodiment of the present invention and illustrated applied to an individual's head;

FIGS. 14 and 15 are perspective views of the hat with the ear flaps in the up position and one up-one down position, respectively;

FIG. 16 is a front elevational view of the hat illustrated in FIG. 13.

DETAILED DESCRIPTION OF THE DRAWING FIGURES

Figure 5:
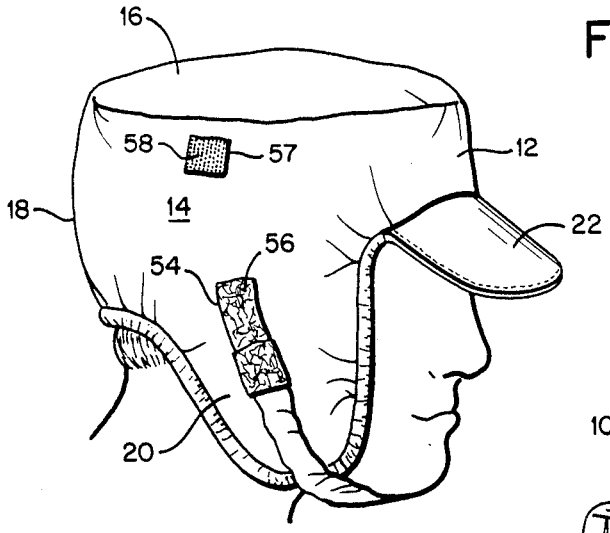
FIG. 5 is a view similar to FIG. 1, but illustrating a second embodiment of the present invention.

Reference will now be made in detail to the present preferred embodiment of the invention, an example of which is illustrated in the drawings.

Referring now to FIG. 1, there is illustrated a hat, generally designated 10, constructed in accordance with the present invention, having front, side, top and back portions 12, 14, 16 and 18, respectively. Side portions 14 have downwardly depending ear flaps 20 for covering the individual's ears. The side, front and rear portions form a generally cylindrical configuration, with the top portion 16 generally forming a circular configuration sewn at its edges to the upper margins of the front, side and back portions. The lower edge of front portion 12 has a visor/bill 22, which projects forwardly in a first position, as illustrated by the dashed lines 24 in FIG. 1, and is movable into a generally upwardly projecting position generally parallel to front portion 12, as illustrated in FIG. 1.

Referring to FIG. 3, it will be seen that the construction of the hat 10 is multi-layered. Particularly, in a preferred form of the present invention, the outer layer 26 is formed of a nylon material affording substantial wind resistance. The intermediate layer is formed of an open-cell polyurethane foam, for example, on the order of about 0.50–0.75 inches thick. The inner layer 30 may be formed of a high permeable and high moisture vapor rate transmitting material, such as nylon tricot.

The inner and outer layers 30 and 26, respectively, are sewn together about the margin of the hat and a binding 32 is folded over on opposite sides of the edges of the inner and outer layers to complete the edge seam. As illustrated in FIG. 1, binding 32 defines the lower margin of the front, side and back portions of the hat. At the lower margin adjacent the front portion 12, the side 14 is cut back such that the juncture of the margin along the forward side edge of ear flap 20 and the lower edge of front portion 12 is spaced back along the side of the individual's face to allow optimal peripheral vision.

It is a particular feature of the present invention that the construction of the ear flap portion of the hat lies in natural conformity to the downwardly and inwardly directed contour of an individual's face, whereby the hat may be applied to the head of the individual without the need for chin straps to maintain the ear flaps in close-fitting conformance therewith. This is provided by sewing binding 32 about the margins of the ear flaps with the inner layer being formed to an outline smaller than the outline of the intermediate and outer layers, whereby the outer and, hence, intermediate layers are drawn inwardly at the distal end of the flaps. Thus, the ear flaps conform to the contour of the side portions of the individual's head and, hence, prevent loss of heat, such conformance assisting in maintaining the hat on the wearer's head, eliminating the need for a chin strap. This conformance of the sides of the hat to the wearer's head is effected, at least in part, by the rear joining seam. The butt ends of the seam consist of two opposing convex curves of such dimensions that when they are joined in the back to form the sides of the hat 14, 12, 18, the circumference around the middle is greater than the circumference around the top of the sides and the bottom of the sides. Thus, when the butt end seams are joined in the back, the hat cups in at the top and bottom to conform to the curvature of the head.

Figure 10:
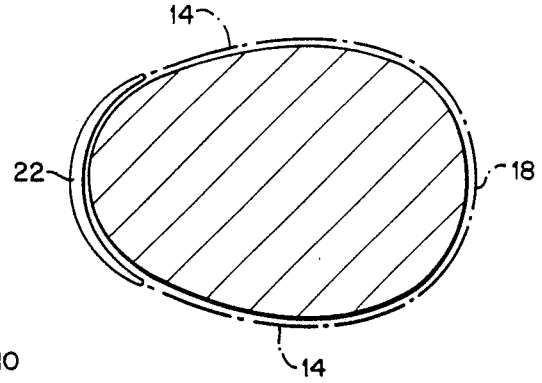
FIGS. 10, 11 and 12 are schematic illustrations of the position of the visor and the margins of the hat about a wearer's head corresponding to the positions of the visor/bill in FIGS. 7–9, respectively.

Bill 22, as illustrated in FIG. 4, includes a substantially stiff material 36 disposed between inner and outer layers of material, which may be the same material forming the outer liner 26 of the hat, i.e., nylon. The inner edge of the bill 22 is sewn at 38 to the inner and outer layers adjacent the edge of the intermediate layer 28, as illustrated in FIG. 4. The seam 38, as viewed from the front of the hat, is upwardly convex and, as viewed in FIG. 10, is curved from the central portion of the bill laterally and rearwardly toward the side portions 14. Thus, in central portions of the hat, the fabric forming the undersurface of bill 22 and a portion 26′ of the inner liner 26 extend downwardly, where their lower edges are sewn at 40 and binding 32 is applied. Seam 38 curves about front portion 12 to meet seam 40 adjacent opposite edges of bill 22 near ear flaps 20. Thus, when bill 22 lies in its down position, illustrated in FIG. 2, its downwardly concave curvature in that position above binding 32, together with the slight rearward curvature of seam 38 at the juncture of the bill and front portion 12 along the front edge of the hat, maintain bill 22 in that position.

Figure 7:
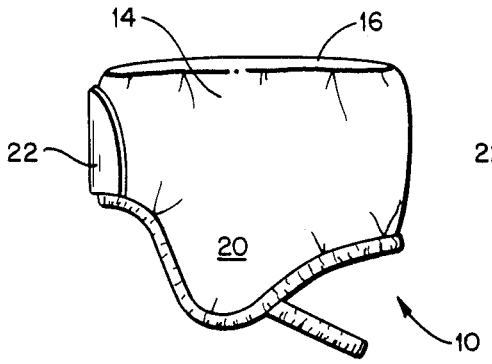
FIGS. 7, 8 and 9 are schematic side elevational views of the hat illustrating the movement of the visor/bill between its up (FIG. 7) and down (FIG. 9) positions through its over-center position (FIG. 8)

Bill 22 may be flipped up to the upwardly projecting position illustrated in FIG. 1 through an over-center action. Thus, when the bill attains the up position illustrated in FIG. 1, the sides of the bill curve in a rearward direction, maintaining that orientation as illustrated in FIGS. 7 and 10, and generally conforming to the curvature of the front portion 12 of the hat. Consequently, the construction of the hat in the area of its attachment to the bill serves to maintain the bill in either one of the two positions and to provide an over-center snap-like action, whereby the bill can be readily and easily moved from one position to the other. Additionally, substantially no pressure is exerted against the forehead of an individual when the bill lies in either one of the up and down positions.

Figure 8:
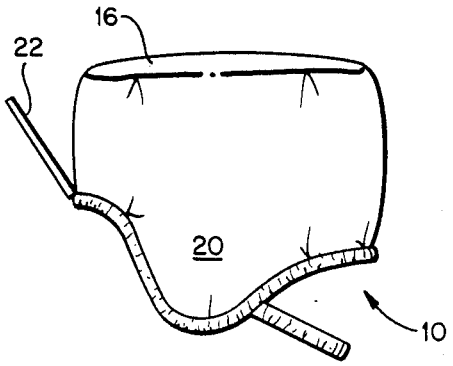
Figure 11:
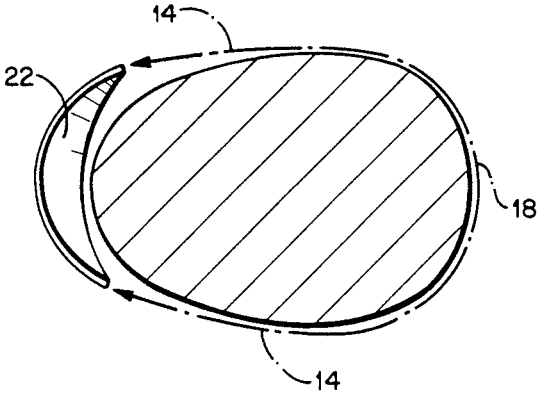
Figure 9:
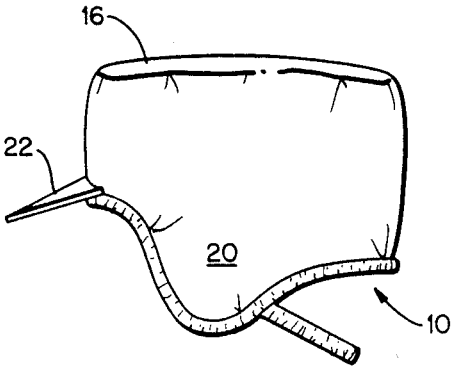
Figure 12:
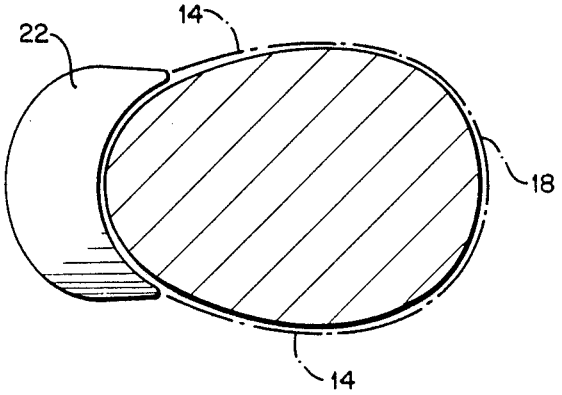

It is a particular feature of the present invention that the hat is specifically constructed to provide this over-center snap-like action whereby the bill can be readily moved between the up and down positions, for example, as illustrated in FIGS. 7 and 9, respectively, and that it is inherently maintained in either the up or down position. The seam 38 by which the bill 22 is secured to the hat is provided with a radius greater than the predetermined radius of the front or forehead portion 12 of the hat. That is, the front or forehead portion of the hat 12 is designed to have a curvature with a predetermined radius and the radius of the seam 38 is such as to be larger than the predetermined radius of the forehead portion of the hat. It will also be appreciated that in the bill-up position (FIGS. 7 and 10), the bill assumes a similar curvature as the curvature of the forehead portion of the hat (see FIG. 10). As the bill is pushed downwardly toward the over-center position illustrated in FIG. 8, the larger radius of the seam 38 with respect to the forehead portion of the hat tends to tension the opposite sides of the hat as the bill is displaced over dead-center position between the up and down positions as illustrated by the arrows in FIG. 11. In displacing the bill between the up and down positions, the bill becomes flat in the dead-center or over-center position (see FIG. 8), which decreases the radius of the visor seam so that the curvature of the seam does not match the curvature of the forehead, rendering the bill unstable in that position vis-a-vis the hat. As the bill is displaced through its dead-center position, the bill assumes a curvature opposite to the curvature in the other position. That is, the bill in the up position is bowed one way, while in the lower position, it is bowed in the opposite direction. The change in the bow direction between the two positions is part of the over-center or toggle action and contributes to the snap action of the visor. The different bows can be seen from a comparison of FIGS. 7 and 9.

It will be appreciated by the foregoing design that the bill folds flat against the curved front of the hat in its up position, completely out of the field of vision of the wearer of the hat. This is significant, for example, in military applications so that the bill may not interfere with the use of certain military equipment, such as gunsights. Also, the bill is readily, easily and positively flipped between positions to allow the wearer to convert quickly from, for example, a shading position, to a bill-up, gunsight position.

Figure 6:
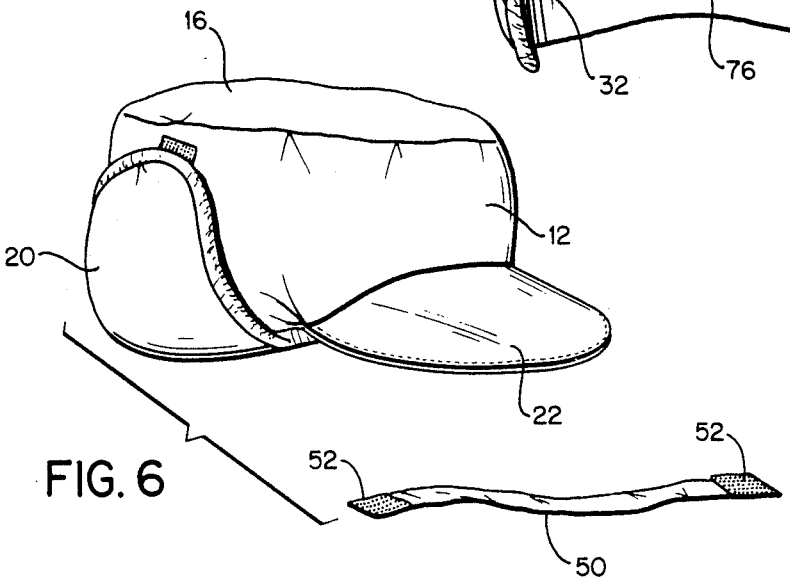
FIG. 6 is a perspective view of the hat illustrated in FIG. 5, with the ear flaps shown in the up or elevated position, together with a separate chin strap for the hat.

Referring now to the embodiment hereof illustrated in FIGS. 5 and 6, there is illustrated a cold weather hat 10*a*, having the same general features as the hat illustrated in FIGS. 1 through 4. However, in this embodiment, the material forming the multi-layered hat construction is different in certain respects. For example, the material forming the outer layer 26 may be formed of material sold by Burlington Industries, Inc. under the name VERSATECH. Thus, the outer layer of material may have an air permeability of less than 15 feet$^3$ per minute per foot$^2$ at 0.5 inches head of water and a moisture vapor transmission rate (MVT) of at least 500 grams per meter$^2$ per 24 hours. The inner layer, in this embodiment, may be formed of a nylon tricot. The present hat provides cold weather headgear which is both warm and dry. The headgear is warm because of the ½″ or more of urethane foam insulation combined with the low air permeability VERSATECH shell fabric. It is dry because both foam and the VERSATECH fabric have a high moisture vapor transport capability.

This high moisture vapor transport provides for the escape of perspiration moisture and also for the escape of any outside water such as rain which penetrates the shell fabric.

In this form of the invention, ear flaps 20 are maintained in their ear covering position by a chin strap 50. Opposite ends of chin strap 50 are provided with one of loops and hooks which cooperate to form a fastener. Particularly, hooks 52 are provided on opposite ends of chin strap 50. A strip 54 carrying complementary hooks or loops, in this case, loops 56, is sewn along the outside of each ear flap 20*a* to terminate adjacent the distal end of the ear flap. Thus, chin strap 50, which may be formed of a flexible elastic material, may be secured at opposite ends to strips 54 and adjusted as desired to maintain proper tension on chin strap 50. With the chin strap 50 secured as illustrated in FIG. 5, the ear flaps are maintained in close-fitting conformal relation to the contour of the sides of the individual's face.

A small patch 57 of one of hooks and loops, in this case, hooks 58, is sewn to each of the upper side portions 14*a*, as illustrated in FIG. 5. Patches 57 serve to provide connecting points for the distal end portions of ear flaps 20*a* when the latter are folded upwardly into an out-of-the-way position, as illustrated in FIG. 6. Thus, the loops 56 at the lower end of strips 54 engage the hooks 58 of patches 57 to releasably secure the flaps in their upper position, uncovering the individual's ears.

Referring now to the embodiment of the hat hereof illustrated in FIGS. 13 through 16, like numerals are applied to like parts of the hat illustrated in the embodiment of FIGS. 1–12, followed by the suffix "a". In this embodiment, the hat 10*a* is provided with an elastic back strap 70. Strap 70 includes an inner elastic band, not shown, sheathed within a gatherable flexible material and secured at opposite ends to the body of the hat 10*a* adjacent the rear margin of each ear flap 20*a*.

Thus, when the hat is worn by an individual, as illustrated in FIG. 13, the elastic back strap 70 tensions the ear flaps in their down position to maintain the hat 10*a* on the individual's head and the ear flaps in the down position. When it is desired to move the ear flaps 20*a* into the up position illustrated in FIG. 14,. the back strap 70 is moved with the ear flaps 20*a* such that it overlies the back 18*a* of the hat. In that position, it maintains the ear flaps 20*a* in the illustrated up position. Referring to FIG. 15, one ear flap 20*a* may be maintained in its down position, while the opposite ear flap 20*a* may be disposed in the up position, for example, when an individual wishes to talk on the telephone. In that position, as illustrated in FIG. 15, the back strap extends from the up ear flap 20*a* partially across the back of the hat to the down ear flap 20*a*.

It will be appreciated that in accordance with the present invention there has been provided an improved cold weather hat, having various improved features, including increased peripheral vision, a hat constructed of material affording minimal heat loss and high vapor transmission rates, and, in one form, a hat which does not require a chin strap to maintain the ear flaps in close-fitting conformal relation to the contour of the individual's face. Also, the improved construction permits movement of the bill between upper and lower positions by a simple snap-type action, whereby the bill can be quickly moved between positions with a quick wipe of the hand or the forearm. This is significant in cold weather conditions, wherein the hands and fingers can remain protected inside a mitten and the bill repositioned with the back of the hand, forearm or object held in a hand or by simply rubbing the hat up or down against another object. Use of fastening devices to maintain the bill in either one of the two positions is also eliminated inasmuch as the bill is self-maintaining in each of its up or down positions.

Figure 17:
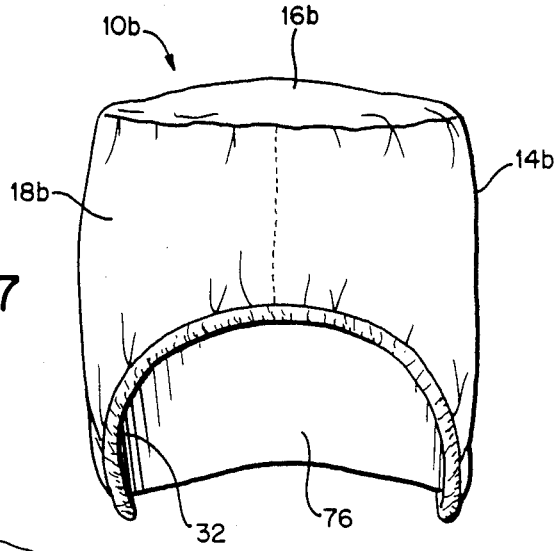
FIG. 17 is a rear elevational view of another embodiment of hat constructed in accordance with the present invention.

In the further embodiment of the present invention illustrated in FIG. 17, wherein like reference numerals apply to like parts, as in the embodiment of FIGS. 1–12, followed by the suffix "b", there is provided in lieu of a back strap 70, an elastic panel 76. The panel spans the generally concave margins of the back side 18*b* of the hat 10*b*. The margins of the elastic panel are preferably sewn to the body of the hat inwardly of the margin 32 of the hat. The elastic panel 76 provides full coverage for the back of the individual's neck and provides similar control over the position and tension on the ear flaps as the strap 70 of the previous embodiment. That is, the elasticity of the panel 76 holds and maintains the ear flaps in the down position. It also holds and maintains the ear flaps in an up position, with the panel folded up along the outside of the back of the hat.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Headwear for cold weather environments comprising:

a hat for substantially enclosing the head of an individual and including a hat body having top, side, front and back portions, said side portions including ear flaps for covering the individual's ears;

said front portion extending downwardly from said top portion to overlie at least a portion of an individual's forehead and terminating in a lower edge, said ear flaps being movable between a first position overlying the individual's ears and a second position extending upwardly generally parallel to the side portions of the hat for exposing the individual's ears, said ear flaps in said first position having forward edges joining with said front portion edge to outline top and side portions of an individual's face with said forward edges of said ear flaps lying naturally in close fitting conformance and generally inwardly directed toward one another to and about the individual's face and throughout their lengths, the body of said hat being formed of an interior lining, an intermediate layer of primarily open-cell foam material, and an outer fabric layer, said interior lining and said outer layer being stitched to naturally curve said ear flaps inwardly when in said first position, to naturally conform to the downwardly and inwardly curved side portions of the individual's face, and a bill projecting from the lower edge of said front portion and movable between a first lowered position projecting generally forwardly of said hat and a second raised position projecting generally upwardly of said hat and generally conformal to said front hat portion, said front hat portion being formed in a natural shape with a predetermined radius approximating the average radius of an individual's forehead, said bill being secured to said front hat portion along a seam having a radius greater than the radius of said front hat portion whereby substantially no pressure is exerted against the forehead of an individual wearing the headwear.

2. Headwear according to claim 1 wherein the forward edges of said ear flaps adjacent their juncture with said front portion edge extend rearwardly along the side of the individual's face to preclude blocking the individual's side vision.

3. Headwear according to claim 1 including cooperating hooks and loops carried on the outside of the side portions and the lower distal end portions of said ear flaps when in said first position whereby, upon moving said flaps into said second position, said flaps may be maintained in said second position by the engagement between said hooks and loops.

4. Headwear according to claim 1 including a chin strap connecting between the distal lower portions of said ear flaps when in said first position, said chin strap at one end thereof and one of said distal ear flap portions having cooperating hooks and loops for releasably securing said chin strap to said one ear flap.

5. Headwear according to claim 1 wherein said bill is curved in opposite directions in said first and second positions thereof and movable between said positions by a snap action.

6. Headwear according to claim 1 including a strap extending between said ear flaps adjacent said back portion of said hat in both said first and second positions of said flaps.

7. Headwear for cold weather environments comprising:

a hat for substantially enclosing the head of an individual and including a hat body having top, side, front and back portions, said side portions including ear flaps for covering the individual's ears;

said front portion extending downwardly from said top portion to overlie at least a portion of an individual's forehead and terminating in a lower edge, said ear flaps being movable between a first position overlying the individual's ears and a second position extending upwardly generally parallel to the side portions of the hat for exposing the individual's ears, said ear flaps in said first position having forward edges joining with said front portion edge to outline top and side portions of an individual's face with said forward edges of said ear flaps lying naturally in close fitting conformance and generally inwardly directed toward one another to and about the individual's face and throughout their lengths, the body of said hat being formed of an interior lining, an intermediate layer of primarily open-cell foam material, and an outer fabric layer, said interior lining and said outer layer being stitched to naturally curve said ear flaps inwardly when in said first position, to naturally conform to the downwardly and inwardly curved side portions of the individual's face, and a bill projecting from the lower edge of said front portion and movable between a first lowered position projecting generally forwardly of said hat and a second raised position projecting generally upwardly of said hat and generally conformal to said front hat portion, said front portion of said hat being formed in a natural shape with a predetermined radius approximating the average radius of an individual's forehead, said bill being secured to said front hat portion along a seam having a radius greater than the radius of said front hat portion.

8. Headwear according to claim 7 wherein said bill is bowed in opposite directions when in said raised and lowered positions and passes through an over-center position between said raised and lowered positions, said bill being secured to said front hat portion such that the radius of said seam approaches said predetermined radius upon displacement of said bill from said over-center position toward said raised position or said lowered position.

9. Headwear according to claim 8 wherein said outer layer comprises a fabric having an air permeability of less than 15 $ft^3$/minute/$ft^2$ at 0.5 inches head of water, and having a moisture vapor transmission rate of at least 500 grams/$m^2$/24 hrs.

10. Headwear according to claim 8 wherein said outer fabric layer is nylon.

11. Headwear according to claim 8 wherein said intermediate layer is comprised of an open cellular foam at least about ½ inch thick.

12. Headwear according to claim 8 wherein said outer fabric layer is a polyester material.

13. Headwear for cold weather environments comprising:

a hat for substantially enclosing the head of an individual and including a hat body having top, side, front and back portions, said side portions including ear flaps for covering the individual's ears;

said front portion extending downwardly from said top portion to overlie at least a portion of an individual's forehead and terminating in a lower edge, said ear flaps being movable between a first position overlying the individual's ears and a second position extending upwardly generally parallel to the side portions of the hat for exposing the individual's ears, said ear flaps in said first position having forward edges joining with said front portion edge to outline top and side portions of an individual's face with said forward edges of said ear flaps lying naturally in close fitting conformance and generally inwardly directed toward one another to and about the individual's face and throughout their lengths, the body of said hat being formed of an interior lining, an intermediate layer of primarily open-cell foam material, and an outer fabric layer, said interior lining and said outer layer being stitched to naturally curve said ear flaps inwardly when in said first position, to naturally conform to the downwardly and inwardly curved side portions of the individual's face, wherein said inner and outer liners have peripheral margins, the outline of the peripheral margin of said inner liner being smaller than the outline of the peripheral margin of said outer liner, and means stitching the peripheral margins of said inner and outer liners one to the other adjacent said outlines to naturally curve the ear flaps inwardly toward one another when in said first position to naturally conform to the downwardly and inwardly curved side portions of the individual's face.

14. Headwear for cold weather environments comprising:

a hat for substantially enclosing the head of an individual and including a hat body having top, side, front and back portions, said side portions including ear flaps for covering the individual's ears;

said front portion extending downwardly from said top portion to overlie at least a portion of an individual's forehead and terminating in a lower edge;

a bill projecting from the lower edge of said front portion and movable between a first lowered position projecting generally forwardly of said hat and a second raised position projecting generally upwardly of said hat and generally parallel to said front hat portion, said front portion being formed in a natural shape with a predetermined radius approximating the average radius of an individual's forehead, said bill being secured to said front hat portion along a seam having a radius greater than the radius of said front hat portion, said bill being bowed in opposite directions when in said raised and lowered positions and passes through an over-center position between said raised and lowered positions, said bill being secured to said front hat portion such that the radius of said seam approaches said predetermined radius upon displacement of said bill from said over-center position toward said raised position or said lowered position.

15. Headwear according to claim 14 wherein the body of said hat is formed of an interior lining, an intermediate layer of primarily open-cell foam material, and an outer fabric layer.

16. Headwear according to claim 15 wherein said outer layer comprises a fabric having an air permeability of less than 15 $ft^3$/minute/$ft^2$ at 0.5 inches head of water, and having a moisture vapor transmission rate of at least 500 grams/$m^2$/24 hrs.

17. Headwear according to claim 15 wherein said intermediate layer is comprised of an open cellular foam at least about ½ inch thick.

18. Headwear for cold weather environments comprising:

a hat for substantially enclosing the head of an individual and including a hat body having top, side, front and back portions, said side portions including ear flaps for covering the individual's ears;

said front portion extending downwardly from said top portion to overlie at least a portion of an individual's forehead and terminating in a lower edge, said ear flaps having forward edges joining with said front portion edge to outline top and side portions of an individual's face with said forward edges of said ear flaps lying naturally in close fitting conformance and generally inwardly directed toward one another to and about the individual's face and throughout their lengths, the body of said hat being formed of an interior lining, an intermediate layer of primarily open-cell foam material, and an outer fabric layer, said interior lining and said outer layer being stitched to naturally curve said ear flaps inwardly when in said first position, to naturally conform to the downwardly and inwardly curved side portions of the individual's face, and a bill projecting from the lower edge of said front portion and movable between a first lowered position projecting generally forwardly of said hat and a second raised position projecting generally upwardly of said hat and generally parallel to said front hat portion, said front hat portion being formed in a natural shape with a predetermined radius approximating the average radius of an individual's forehead, said bill being secured to said front hat portion along a seam having a radius greater than the radius of said front hat portion whereby substantially no pressure is exerted against the forehead of an individual wearing the headwear.

19. Headwear according to claim 18 wherein the forward edges of said ear flaps adjacent their juncture with said front portion edge extend rearwardly along the side of the individual's face to preclude blocking the individual's side vision.

20. Headwear according to claim 18 wherein said ear flaps are stitched to naturally curve inwardly to naturally conform to the downwardly and inwardly curved side portions of the individual's face.

21. Headwear according to claim 18 wherein said bill is curved in opposite directions in said first and second positions thereof and movable between said positions by a snap action.

22. Headwear according to claim 18 wherein the body of said hat is formed of an interior lining, an intermediate layer of primarily open-cell foam material, and an outer fabric layer.

23. Headwear according to claim 22 wherein said outer layer comprises a fabric having an air permeability of less than 15 $ft^3$/minute/$ft^2$ at 0.5 inches head of water, and having a moisture vapor transmission rate of at least 500 grams/$m^2$/24 hrs.

24. Headwear according to claim 23 including a strap extending between said ear flaps adjacent said back portion of said hat in both said first and second positions of said flaps.

25. Headwear according to claim 24 wherein said strap is formed of an elastic material.

* * * * *